US009482992B2

(12) United States Patent
Furukawa

(10) Patent No.: US 9,482,992 B2
(45) Date of Patent: Nov. 1, 2016

(54) TONER CONVEYANCE MEMBER, DEVELOPING DEVICE, AND IMAGE FORMING APPARATUS

(71) Applicant: KONICA MINOLTA, INC., Chiyoda-ku, Tokyo (JP)

(72) Inventor: Kunio Furukawa, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/943,428

(22) Filed: Nov. 17, 2015

(65) Prior Publication Data

US 2016/0139542 A1 May 19, 2016

(30) Foreign Application Priority Data

Nov. 18, 2014 (JP) ..... 2014-233721

(51) Int. Cl.
*G03G 15/08* (2006.01)

(52) U.S. Cl.
CPC ..... *G03G 15/0891* (2013.01); *G03G 15/0889* (2013.01); *G03G 2215/0819* (2013.01); *G03G 2215/0822* (2013.01); *G03G 2215/0827* (2013.01)

(58) Field of Classification Search
CPC ..... G03G 15/0891; G03G 15/0889; G03G 2215/0819; G03G 2215/0822; G03G 2215/0827
See application file for complete search history.

(56) References Cited

U.S. PATENT DOCUMENTS

| | | | | |
|---|---|---|---|---|
| 8,620,191 | B2 * | 12/2013 | Okazaki | G03G 15/0893 399/254 |
| 2003/0175050 | A1 * | 9/2003 | Murayama | G03G 15/0877 399/256 |
| 2007/0189810 | A1 * | 8/2007 | Ohsawa | G03G 15/0877 399/254 |
| 2009/0257761 | A1 * | 10/2009 | Kato | G03G 15/0893 399/30 |
| 2011/0158700 | A1 * | 6/2011 | Iwata | G03G 15/0889 399/254 |
| 2015/0003876 | A1 * | 1/2015 | Iida | G03G 15/0891 399/254 |

FOREIGN PATENT DOCUMENTS

JP 2006-337817 A 12/2006

* cited by examiner

*Primary Examiner* — Rodney Bonnette
(74) *Attorney, Agent, or Firm* — Buchanan Ingersoll & Rooney PC

(57) ABSTRACT

A toner conveyance member includes a shaft, a first blade member, at least one paddle member, and a pressure relief path. The shaft extends in a first direction and rotates in a second direction. The first blade member winds around the shaft and continues to extend helically in the first direction. The paddle member is in the form of a plate protruding from a surface of the shaft and having a first principal face and a second principal face positioned opposite to and forward from the first principal face in the second direction. The pressure relief path has an opening. The opening is provided within a predetermined distance range from an intersection point of the shaft, the first blade member, and the second principal face of the paddle member.

14 Claims, 12 Drawing Sheets

TONER CONVEYANCE MEMBER, DEVELOPING DEVICE, AND IMAGE FORMING APPARATUS

This application is based on Japanese Patent Application No. 2014-233721 filed on Nov. 18, 2014, the content of which is incorporated herein by reference.

BACKGROUND OF THE INVENTION

1. Field of the Invention

The present invention relates to a toner conveyance member for conveying toner in an electrophotographic image forming apparatus, as well as a developing device and an image forming apparatus using the same.

2. Description of Related Art

For example, the toner conveyance member is provided as a supply screw or a stirring screw in a developing device included in an electrophotographic image forming apparatus, as described in Japanese Patent Laid-Open Publication No. 2006-337817.

More specifically, the developing device has a developer (e.g., a two-component developer) stored in a developer container. The developer container includes a developing roller horizontally disposed near a photoreceptor drum so as to be approximately parallel to the photoreceptor drum. When the developing roller rotates, the developer in the developer container is conveyed and supplied to a developing area on the photoreceptor drum while being carried on the outer circumferential surface of the developing roller.

Provided almost directly below the developing roller is a supply screw. The supply screw is horizontally disposed near the developing roller in the developer container so as to be approximately parallel to the developing roller. Moreover, provided diagonally below the supply screw is a stirring screw. The stirring screw is disposed horizontally in the developer container so as to be approximately parallel to the supply screw with a partition extending along the supply screw between the stirring screw and the supply screw.

A conventional toner conveyance member will be described in detail below with reference to FIG. 12. In FIG. 12, the toner conveyance member 101 includes a shaft 102, a blade member 103, and paddle members 104.

The blade member 103 is a helical fin winding around the outer circumferential surface of the shaft 102 in the direction of arrow θ2 (also referred to below as the "rotational direction θ2" or simply as the "direction θ2"), and the fin continues to extend helically in the axial direction y of the shaft 102.

The paddle members 104 are in the form of plates protruding approximately perpendicularly from the outer circumferential surface of the shaft 102 and extending in the axial direction y. Moreover, the entire end of each paddle member 104 in the axial direction y is connected to the blade member 103.

In the case of the toner conveyance member 101 thus configured, once the shaft 102 rotates, the blade member 103 conveys the developer in the opposite direction to the axial direction y. Moreover, the paddle members 104 move and stir the developer in the rotational direction θ2 of the shaft 102.

However, the conventional toner conveyance member 101 has a problem of being prone to toner aggregation. More specifically, as shown in a dotted circle in FIG. 12, there are two spaces defined by the shaft 102, the blade member 103, and the paddle member 104, and one of the spaces that is positioned forward in the rotational direction θ2 with respect to the paddle member 104 is referred to as a recess 105. Once toner T enters the recess 105 (see the hatched portion in the figure), the toner T is unlikely to move out of the recess 105 due to the paddle member 104 rotating in the rotational direction θ2. Accordingly, the toner T in the recess 105 keeps receiving pressure for a prolonged period of time, resulting in aggregation of the toner T.

SUMMARY OF THE INVENTION

A toner conveyance member according to an embodiment of the present invention includes a shaft, a first blade member, at least one paddle member, and a pressure relief path. The shaft extends in a first direction and rotates in a second direction. The first blade member winds around the shaft and continues to extend helically in the first direction. The paddle member is in the form of a plate protruding from a surface of the shaft and having a first principal face and a second principal face positioned opposite to and forward from the first principal face in the second direction. The pressure relief path has an opening. The opening is provided within a predetermined distance range from an intersection point of the shaft, the first blade member, and the second principal face of the paddle member.

A toner conveyance member according to another embodiment of the present invention includes a shaft, a first blade member, at least one paddle member, and a pressure relief path. The shaft extends in a first direction and rotates in a second direction. The first blade member winds around the shaft and continues to extend helically in the first direction. The paddle member is in the form of a plate protruding from a surface of the shaft and having a first principal face and a second principal face positioned opposite to and forward from the first principal face in the second direction. The pressure relief path has an opening. The opening is provided in a recess defined by the shaft, the first blade member, and the second principal face of the paddle member.

A developing device according to another embodiment of the present invention includes a container, a rotating member, and a toner conveyance member of any of the above embodiments. The container is capable of storing toner. The rotating member is rotatable about an axis and disposed horizontally within the container to carry and transport the toner from the container. The toner conveyance member is disposed rotatably and horizontally in the container and is approximately parallel to the rotary.

An image forming apparatus according to another embodiment of the present invention includes a toner conveyance member of any of the above embodiments or a developing device of the above embodiment.

DETAILED DESCRIPTION OF THE PREFERRED EMBODIMENTS

Figure 1:
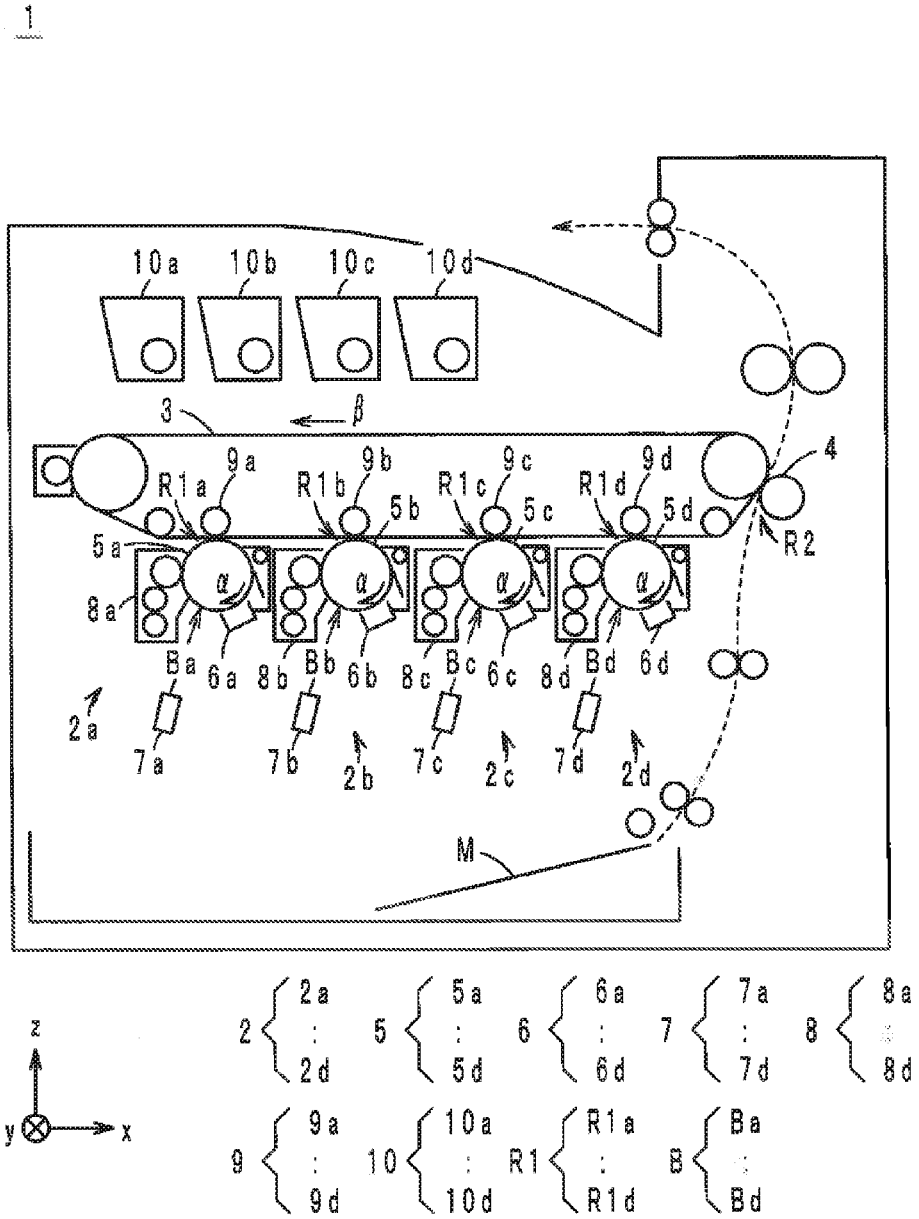
FIG. 1 is a view illustrating a general configuration of an image forming apparatus.

Hereinafter, toner conveyance members according to embodiments of the present invention, along with developing devices and image forming apparatuses, will be described in detail with reference to the drawings.

Section 1

Definitions

In some figures, the x-, y-, and z-axes are perpendicular to one another, and represent the right-left, front-back, and up-down direction of the image forming apparatus 1. Moreover, some reference characters herein and also in the drawings are suffixed with the lowercase alphabet letter "a", "b", "c", or "d". The letters "a", "b", "c", and "d" respectively denote yellow (Y), magenta (M), cyan (C), and black (K). For example, the term "photoreceptor drum 5*a*" refers to a photoreceptor drum for yellow. Moreover, any reference character which can be suffixed with such a letter but has no letter added thereto represents one or any of the colors. For example, the term "photoreceptor drum 5" refers to a photoreceptor drum for one or any of the colors Y, M, C, and K.

Section 2

Overall Configuration and Print Operation of Image Forming Apparatus

In FIG. 1, the image forming apparatus 1 is, for example, a copier, printer, or fax machine, or a multifunction machine provided with all or some of the functions, and is adapted to print a variety of types of images (typically, full-color or monochrome images) on sheets of paper M using a tandem system with a well-known electrophotography technology. To this end, the image forming apparatus 1 typically includes imaging units 2, an intermediate transfer belt 3, and a secondary transfer roller 4. The configuration for full-color printing will be described below.

For example, the imaging units 2 are arranged side by side so as to be approximately parallel to the x-axis, and include one photoreceptor drum 5 each.

The photoreceptor drum 5 is in the shape of a column extending in the y-axis direction, and rotates, for example, in the direction of arrow α (referred to below as the "rotational direction α"). Arranged around the photoreceptor drum 5, from upstream to downstream in the rotational direction α, are, at least, a charger 6, a developing device 8, and a primary transfer roller 9.

The charger 6 uniformly charges the circumferential surface of the photoreceptor drum 5 while the photoreceptor drum 5 is rotating.

Provided below the photoreceptor drum 5 is an exposing device 7. The exposing device 7 irradiates an exposure area of the photoreceptor drum 5, which is immediately downstream from the charged area, with an optical beam B based on image data, thereby forming an electrostatic latent image in a corresponding color.

The developing device 8 supplies a developer for the corresponding color to a developing area of the photoreceptor drum 5, which is immediately downstream from the exposure area, thereby forming a toner image in the corresponding color in the developing area.

The intermediate transfer belt 3 is a so-called endless belt, which is stretched between outer circumferential surfaces of at least two rollers arranged in the right-left direction, and rotates, for example, in the direction of arrow β. The outer circumferential surface of the intermediate transfer belt 3 abuts the upper end of each photoreceptor drum 5.

The primary transfer roller 9 is positioned opposite to the photoreceptor drum 5 with the intermediate transfer belt 3 positioned therebetween, and presses the inner circumferential surface of the intermediate transfer belt 3 from above, thereby creating a primary transfer area R1 between the photoreceptor drum 5 and the intermediate transfer belt 3. The toner image formed on the photoreceptor drum 5 is transferred to the primary transfer area R1 on the intermediate transfer belt 3 while the intermediate transfer belt 3 is rotating.

The secondary transfer roller 4 is positioned near the right end of the intermediate transfer belt 3, and presses the outer circumferential surface of the intermediate transfer belt 3, thereby creating a secondary transfer area R2 at the contact between the secondary transfer roller 4 and the intermediate transfer belt 3. In the secondary transfer area R2, the image carried on the intermediate transfer belt 3 is transferred to the sheet M. The sheet M passes through a well-known fuser, and thereafter is ejected into a tray as a print.

Furthermore, disposed above the intermediate transfer belt 3 are cartridges 10. Each cartridge 10 contains a developer including, for example, low fusing temperature toner, and replenishes its corresponding developing device 8 with a developer when the amount of toner remaining in the developing device 8 decreases to a reference value or lower. Moreover, the cartridge 10 is detachable from the image forming apparatus 1, and therefore, when the cartridge 10 is completely (or nearly) emptied, the cartridge 10 is replaceable with a new cartridge 10.

Section 3

Details of Configuration and Operation of Developing Device

Figure 2:
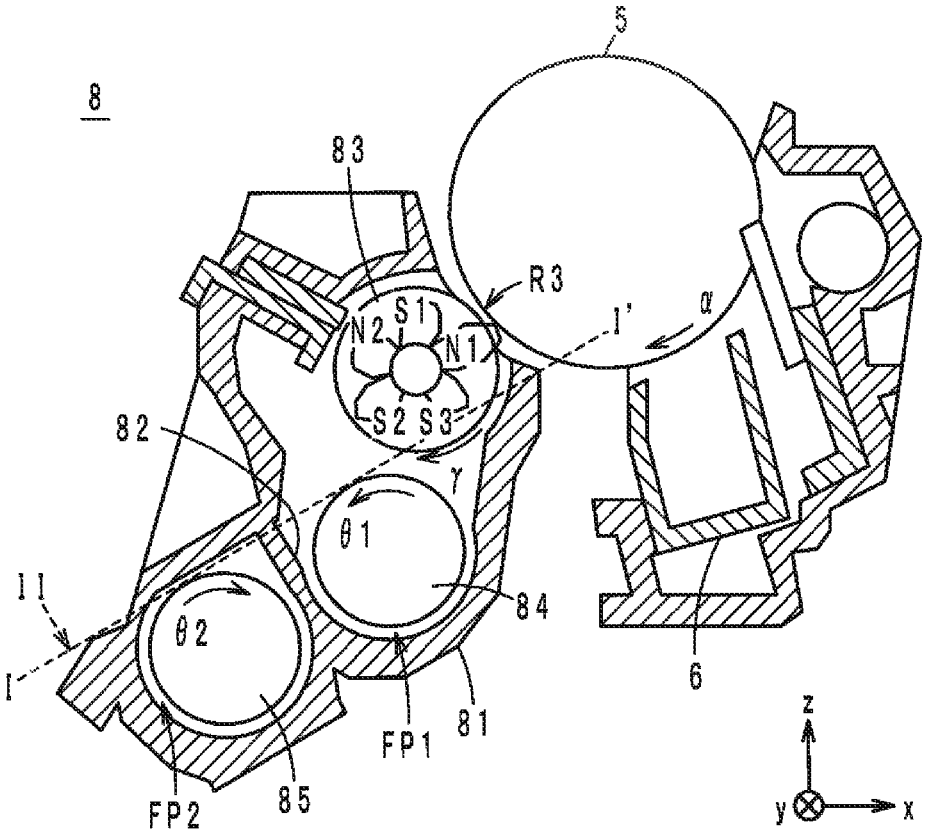
FIG. 2 is a schematic view illustrating a cross section of a developing device taken along zx plane in FIG. 1.

Next, the configuration and the operation of the developing device 8 will be described in detail with reference to FIGS. 2 and 3.

The developing device 8 includes a developer container 81 and a partition 82. The developer container 81 is disposed along the photoreceptor drum 5 for its corresponding color. More specifically, the developer container 81 has an opening in a position where the developer container 81 faces a developing area R3 for the corresponding color, and the developer container 81 is disposed such that the opening is positioned proximal to the developing area R3. The partition 82 protrudes approximately upward from the bottom of the developer container 81, and extends in the y-axis direction, so that the container is divided into a first conveyance path FP1 and a second conveyance path FP2. The first conveyance path FP1 is closer to the photoreceptor drum 5 than is the second conveyance path FP2. Moreover, the conveyance paths FP1 and FP2 communicate with each other at least in two places whose positions in the y-axis direction are different (e.g., at both the front and back ends). The developer container 81 as above has a developer for the corresponding color stored therein.

The developing device 8 further includes a developing roller 83 having poles, such as a receiving pole S2 and a developing pole N1, arranged in fixed positions within a rotatable sleeve. The developing roller 83 is disposed so as to be approximately parallel to the photoreceptor drum 5 and proximal to the developing area R3, and further, the developing roller 83 spans from one side to the other within the developer container 81 and is rotatable in the direction of arrow γ. The developing roller 83 receives the developer from a supply screw 84, which will be described later, at the receiving pole S2, and carries the developer on its outer circumferential surface. The developing roller 83 conveys the developer on the outer circumferential surface to the developing pole N1 by rotating in the direction of arrow γ.

The developing device 8 further includes the supply screw 84, which is a first example of the toner conveyance member and is disposed almost directly below the developing roller 83 in the first conveyance path FP1. The supply screw 84 is disposed so as to be approximately parallel to and proximal to the developing roller 83, and further, the supply screw 84 spans from one side to the other in the first conveyance path FP1 and is rotatable in the direction of arrow θ1. Through rotation, the supply screw 84 supplies the developer to the receiving pole S2, and also conveys the developer in the opposite direction to the y-axis direction (i.e., forward) in the first conveyance path FP1 while stirring the developer. Once the developer is conveyed to the front end of the first conveyance path FP1 (i.e., the starting end in the y-axis direction), the developer flows from the first conveyance path FP1 into the second conveyance path FP2 through the communicating portion. Note that the directions in which the developer flows in the conveyance paths FP1 and FP2 are indicated by arrows in the figures.

The developing device 8 further includes a stirring screw 85, which is a second example of the toner conveyance member. The stirring screw 85 is disposed in the second conveyance path FP2 so as to be approximately parallel to the supply screw 84, and further, the stirring screw 85 spans from one side to the other in the second conveyance path FP2 and is rotatable in the direction of arrow θ2. Through rotation, the stirring screw 85 conveys the developer in the second conveyance path FP2 in the y-axis direction (i.e., backward) while stirring the developer, so that the developer flows from the second conveyance path FP2 into the first conveyance path FP1 through the communicating portion.

Furthermore, to receive a supplementary developer from the cartridge 10, the developing device 8 includes a replenishment port 86 and a density sensor 87.

In the present embodiment, the replenishment port 86 is provided at the starting end of the second conveyance path FP2 in the y-axis direction, and is used to introduce the developer fed from the cartridge 10 into the developer container 81.

Moreover, the density sensor 87 is provided, for example, in the second conveyance path FP2 at a predetermined distance from the replenishment port 86 in the y-axis direction. The density sensor 87 uses a well-known detecting method (e.g., optical detection or magnetic permeability detection) to detect the amount of toner remaining in a detection area R4 close to the position where the sensor itself is installed within the developer container 81.

Section 4

First Embodiment of Toner Conveyance Member

A stirring screw 85 in a first embodiment of the toner conveyance member will be described in detail below with reference to FIG. 4.

The stirring screw 85 is made from, for example, a resin by injection forming or suchlike. The stirring screw 85 includes a shaft 91, a first blade member 92, paddle members 93, and at least one pressure relief path 94A.

The shaft 91 is a columnar rotational shaft extending in the opposite direction to the y-axis direction, the opposite direction being an example of a first direction. The shaft 91 rotates counterclockwise, as indicated by arrow θ2, when viewed forward from the negative side in the y-axis direction, the counterclockwise direction θ2 (also referred to as the "rotational direction θ2" or simply as the "direction θ2") being an example of a second direction.

The first blade member 92 is a helical fin winding around the outer circumferential surface of the shaft 91 in the rotational direction θ2, and the fin continues to extend helically in the first direction (i.e., the opposite direction to the y-axis direction).

The paddle members 93 protrude from different y-axis positions on the outer circumferential surface of the shaft 91 so as to be approximately perpendicular to the outer circumferential surface of the shaft 91. Moreover, the paddle members 93 are in the form of plates extending in the y-axis direction. In this preferred embodiment, the paddle members 93 are provided in a straight line, one for each pitch of the first blade member 92. Furthermore, the entire end of each paddle member 93 on the positive side in the y-axis direction is not connected to the first blade member 92. In other words, no paddle member 93 exists on the upstream side in the toner conveyance direction with respect to the first blade member 92.

Figure 4:
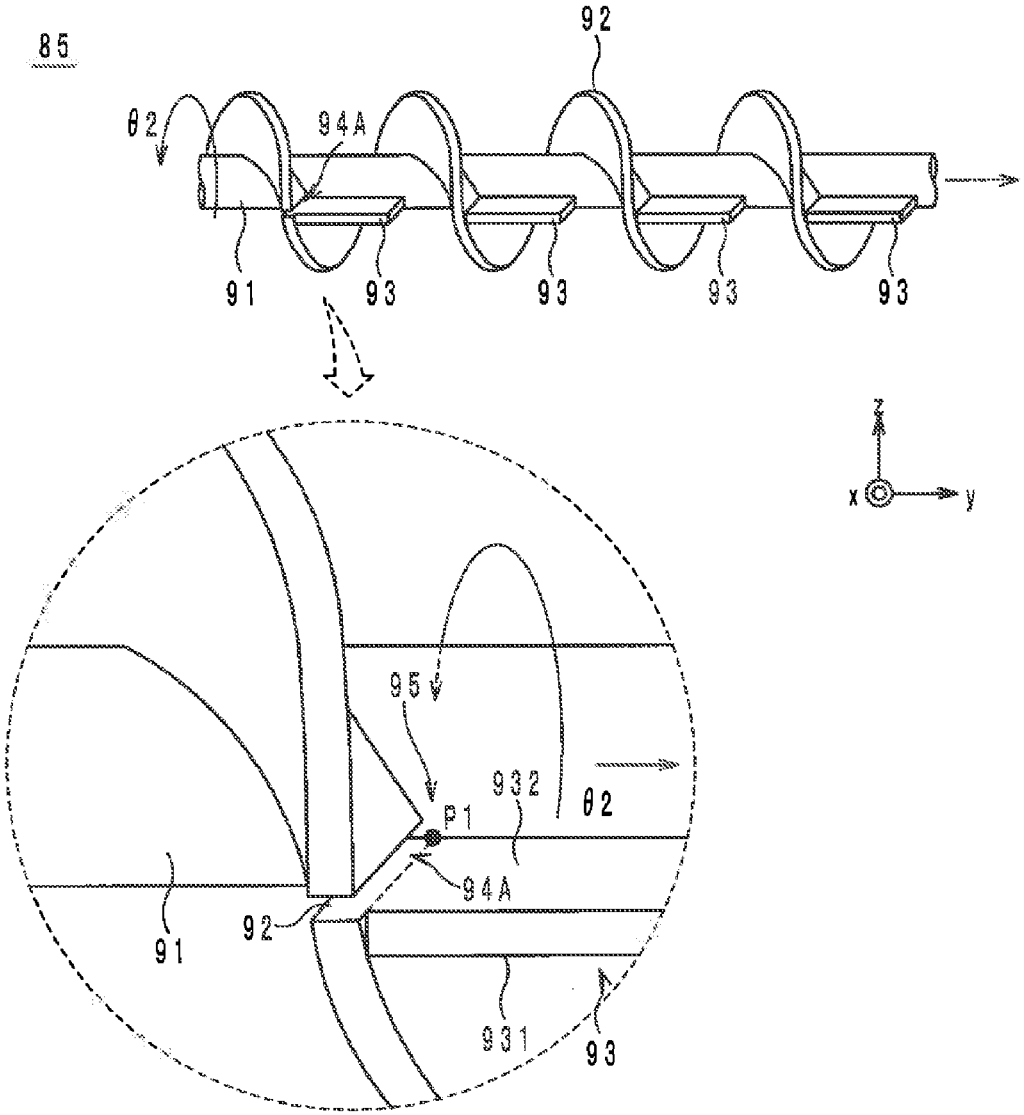
FIG. 4 is a view illustrating the configuration of a stirring screw in a first embodiment of a toner conveyance member.

Furthermore, each paddle member 93 has a first principal face 931 and a second principal face 932 positioned opposite to and forward from the first principal face 931 in the rotational direction θ2, as shown in an enlarged view in a dotted circle in FIG. 4. In this section, the first principal face 931 and the second principal face 932 are exemplified as having approximately rectangular shapes.

The pressure relief path 94A is provided in the first blade member 92 in the vicinity of at least one paddle member 93, and in this section, the pressure relief path 94A is described as being a slit provided in the form of a straight line from the outer edge of the first blade member 92 to the outer circumferential surface of the shaft 91 along the second principal face 932 of the paddle member 93. The slit is provided completely through the first blade member 92 in the opposite direction to the y-axis direction.

Furthermore, as shown in the dotted circle in FIG. 4, the intersection of the surface of the shaft 91, the surface of the first blade member 92, and the paddle member 93 includes intersection point P1, which is the foremost point in the rotational direction θ2 of the shaft 91, i.e., the surface of the shaft 91, the surface of the first blade member 92, and the second principal face 932 of the paddle member 93 meet at intersection point P1. The pressure relief path 94A is open at least within an approximately 3 mm range from intersection point P1.

From another perspective, the pressure relief path 94A is open at a recess 95 defined by the shaft 91, the first blade member 92, and the second principal face 932, as shown in the dotted circle in FIG. 4.

In this section, the pressure relief path 94A is described as being open in the aforementioned position in relation to the preferred embodiment. However, this is not limiting, and the pressure relief path 94A, when viewed in a plan view in the y-axis direction, may be open within an angular range of from 0° to 90° with respect to the second principal face 932 in the rotational direction θ2.

Figure 3:
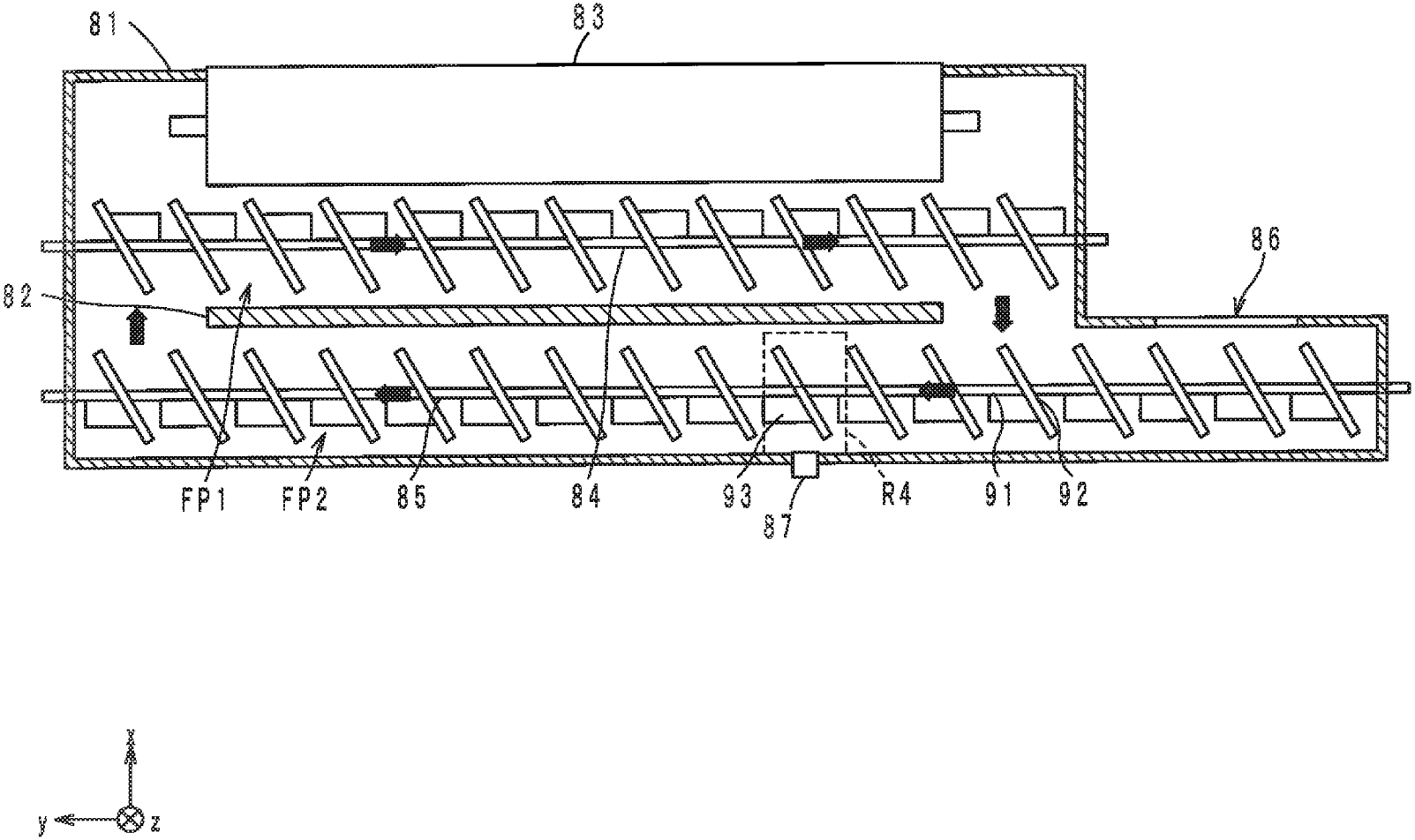
FIG. 3 is a schematic view illustrating a cross section of the developing device taken along line I-I' in FIG. 2 as seen in the direction of arrow II.

The stirring screw 85 as above is disposed horizontally in the second conveyance path FP2 such that the direction of helical progression (i.e., the first direction) is opposite to the toner conveyance direction in the second conveyance path FP2, as shown in FIG. 3, and therefore, at least one of the paddle members 93 and a portion of the first blade member 92 cross the detection area R4 for the density sensor 87. The pressure relief path 94A is preferably a portion of the first blade member 92 that, at least, passes through the detection area R4 and is located near the paddle member 93 that is positioned within the detection area R4 when the stirring screw 85 is disposed horizontally.

The supply screw 84 may have the same structure as the stirring screw 85 or may be configured by omitting the pressure relief path 94A from the stirring screw 85. The supply screw 84 is disposed horizontally in the first conveyance path FP1 such that the direction of helical progression of the first blade member provided thereto is opposite to the direction of helical progression of the first blade member 92 of the stirring screw 85 (i.e., the first blade member of the supply screw 84 helically extends in the y-axis direction).

Section 5

Actions and Effects of Toner Conveyance Member

Figure 12:
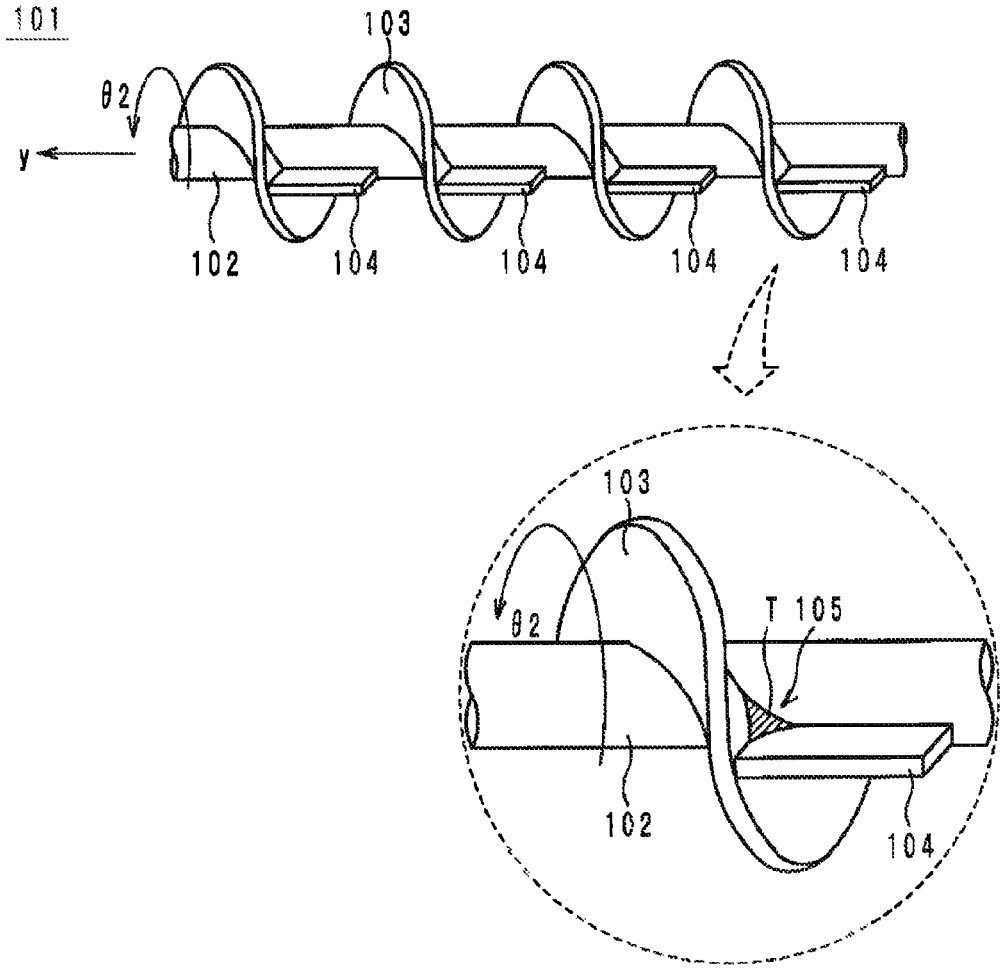
FIG. 12 PRIOR ART
FIG. 12 is a view illustrating the configuration of a conventional toner conveyance member.

In the case of the conventional toner conveyance member 101, the shaft 102 rotates in the direction θ2 during the above-described print operation, as shown in the dotted circle in FIG. 12, so that the toner T in the recess 105 continues to receive pressure, and therefore, toner aggregation occurs readily. On the other hand, in the case of the stirring screw 85 shown in FIG. 4, when the shaft 91 rotates in the direction θ2, some pressure applied to the toner in the recess 95 can escape through the pressure relief path 94A, which is open at intersection point P1 and in its vicinity. Thus, toner aggregation can be suppressed. Depending particularly on the specifications of the image forming apparatus 1, the shaft 91 might be rotated at high speed, or toner with low storage stability (i.e., low fusing temperature toner) might be used, but even in such a case, using the toner conveyance member in FIG. 4 makes it possible to suppress toner aggregation.

In the case where the supply screw 84 is provided with the pressure relief path 94A as described above, the supply screw 84 also renders it possible to achieve the same actions and effects as described above.

Incidentally, in the case where a stirring screw without the pressure relief path 94A is used, if toner aggregation occurs in the detection area R4, the conveyance and stirring performance of the stirring screw might decrease in the detection area R4, resulting in toner accumulation in the detection area R4. In such a case, the density sensor 87 might output detection results with a margin of error. However, the portion of the first blade member 92 that crosses the detection area R4 is provided with the pressure relief path 94A, as described above, so that toner aggregation is suppressed, whereby the density sensor 87 can output detection results with a reduced margin of error.

Section 6

Pressure Relief Paths in Other Shapes

Figure 5:
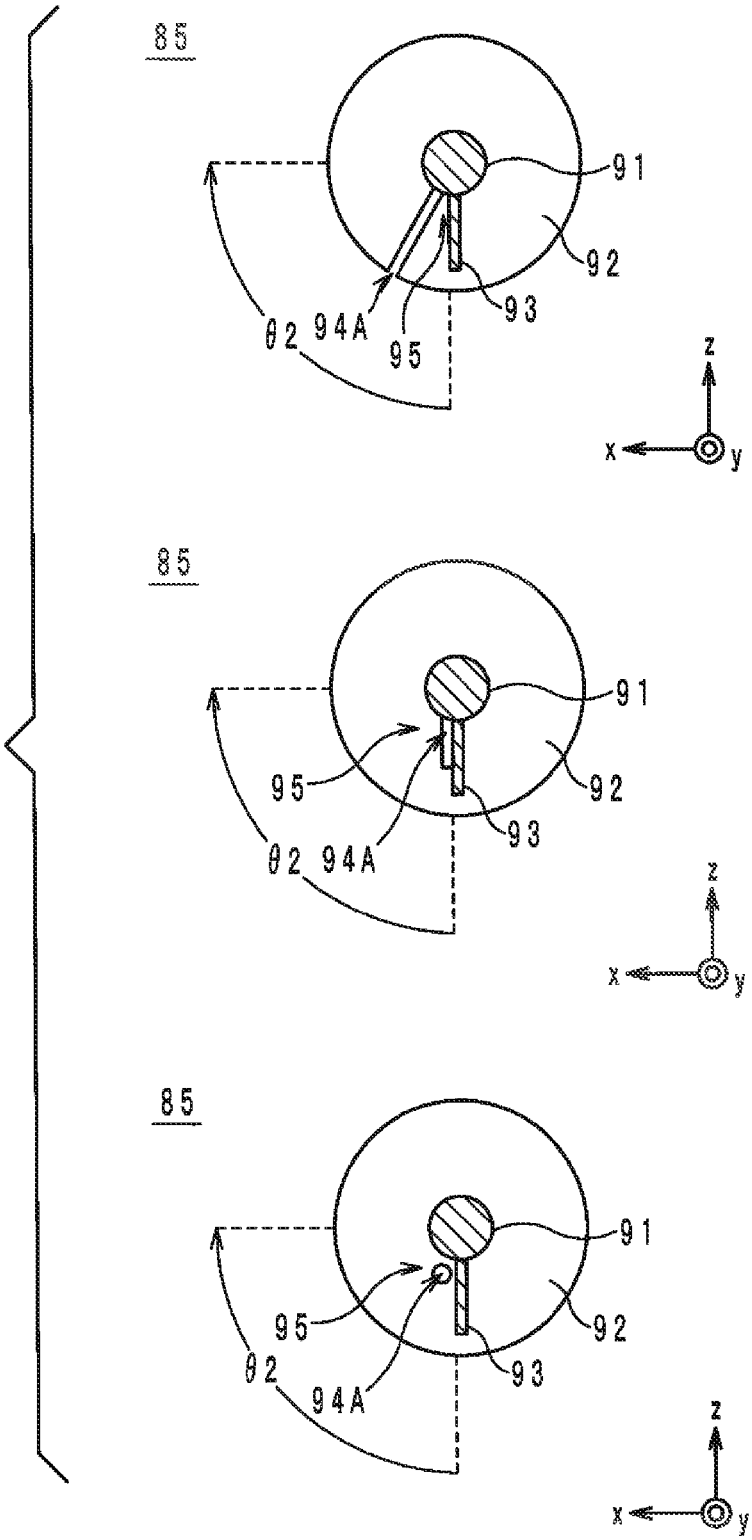
FIG. 5 is a view illustrating a pressure relief path in FIG. 4 in other shapes.

The pressure relief path 94A is not limited to the slit described in the fourth column and the example in FIG. 4, and may be a slit provided in the first blade member 92 in the form of a straight line such that the distance between the slit and the paddle member 93 gradually increases in the direction from the shaft 91 to the outer edge of the first blade member 92 when viewed in a plan view in the y-axis direction, as shown in the top panel of FIG. 5, the slit being open at intersection point P1 (see FIG. 4) and in its vicinity.

The pressure relief path 94A may be provided in other forms, which include: an opening provided completely through the first blade member 92 in an area including intersection point P1 (see FIG. 4) and its vicinity when viewed in a plan view in the y-axis direction, as shown in the middle panel of FIG. 5; and an opening provided completely through the first blade member 92 within a predetermined distance range (e.g., about 3 mm or less) from intersection point P1 (see FIG. 4) when viewed in a plan view in the y-axis direction, as shown in the lower panel in FIG. 5.

Alternatively, each of the pressure relief paths 94A shown in FIG. 5 may be provided in the recess 95 or may be provided within an angular range of from 0° to 90° with respect to the second principal face 932 in the direction θ2.

Section 7

First Modification of Toner Conveyance Member

Figure 6:
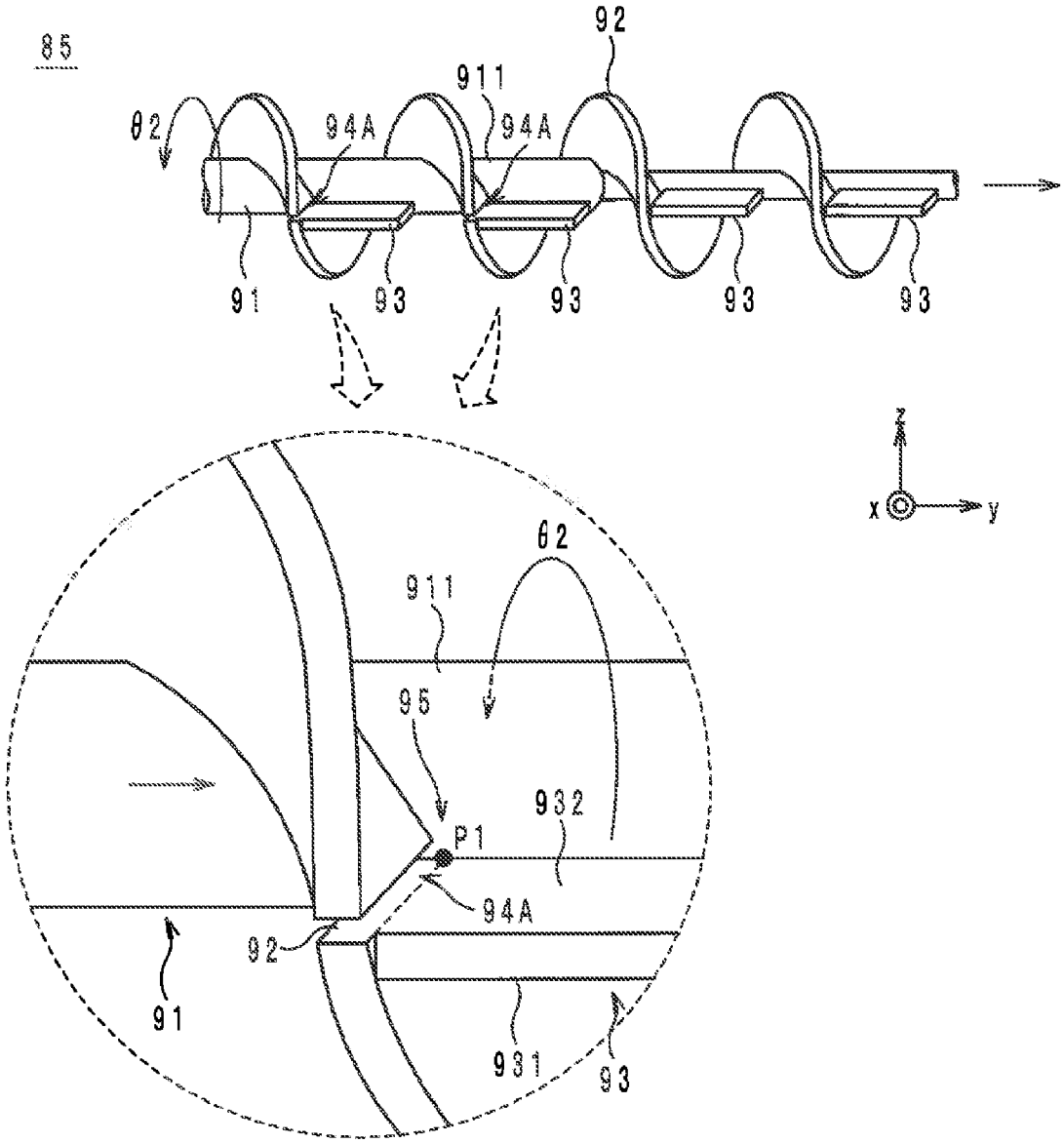
FIG. 6 is a view illustrating a stirring screw in a first modification of the first embodiment.

Incidentally, the diameter of the shaft 91 might differ depending on the position in the y-axis direction, as shown in FIG. 6. In FIG. 6, the shaft 91 includes a portion 911 with a larger diameter, and the recess 95 is defined by the portion 911, the first blade member 92, and the second principal face 932 of the paddle member 93 provided on the portion 911. Because of, for example, a relatively large centrifugal force being applied through the rotation of the shaft 91 in the direction θ2, toner trapped in the recess 95 readily aggregates. Accordingly, the opening of the pressure relief path 94A is preferably provided in the recess 95 (in other words, in an area including intersection point P1 of the portion 911, the first blade member 92, and the second principal face 932 of the paddle member 93 protruding from the portion 911, as well as the vicinity of intersection point P1).

Section 8

Second Modification of Toner Conveyance Member

Figure 7:
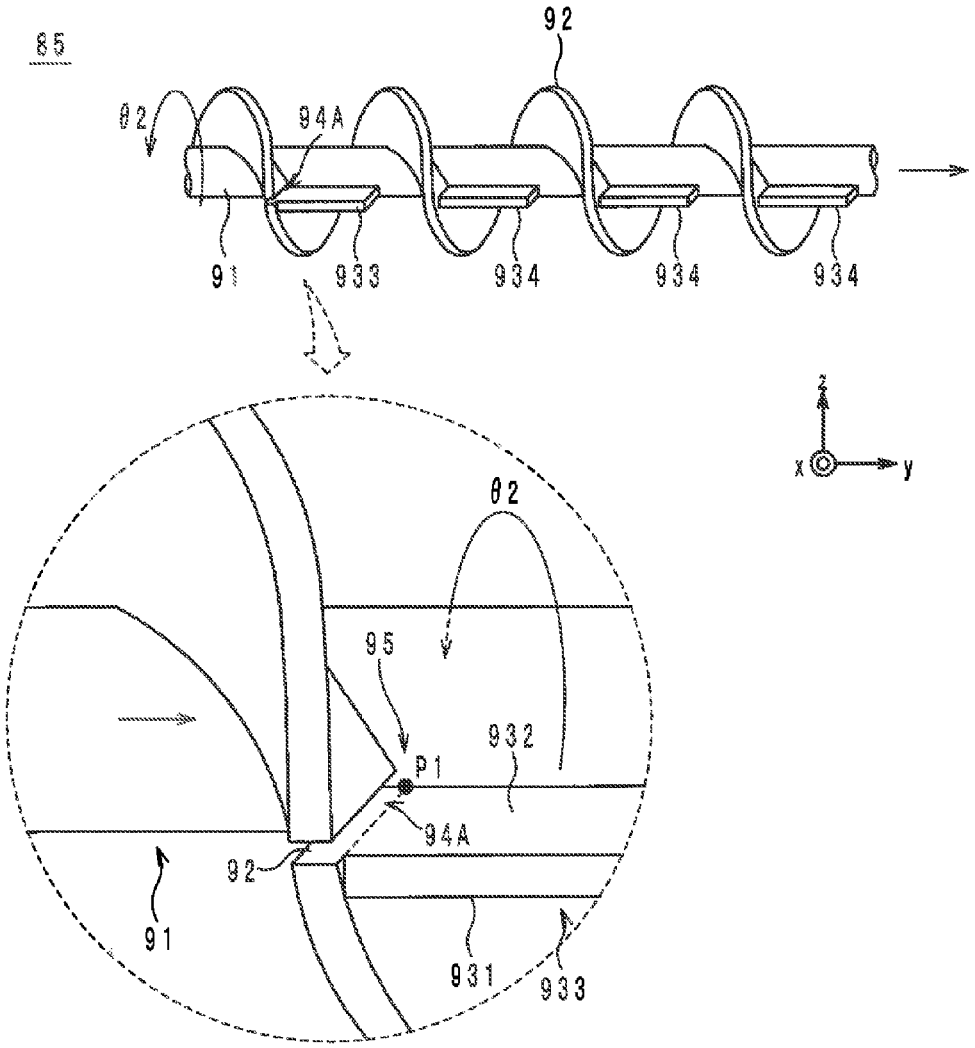
FIG. 7 is a view illustrating a stirring screw in a second modification of the first embodiment.

In some cases, the paddle members 93 include at least one first paddle member 933 and at least one second paddle member 934, as shown in FIG. 7. Here, when compared to the second paddle member 934, the first paddle member 933 has a relatively large second principal face 932. In such a case, the recess 95, which is defined by the shaft 91, the first blade member 92, and the second principal face 932 of the first paddle member 933, is prone to toner accumulation, and therefore, the pressure relief path 94A preferably has an opening in the recess 95 (including intersection point P1 and its vicinity).

Section 9

Third Modification of Toner Conveyance Member

Figure 8:
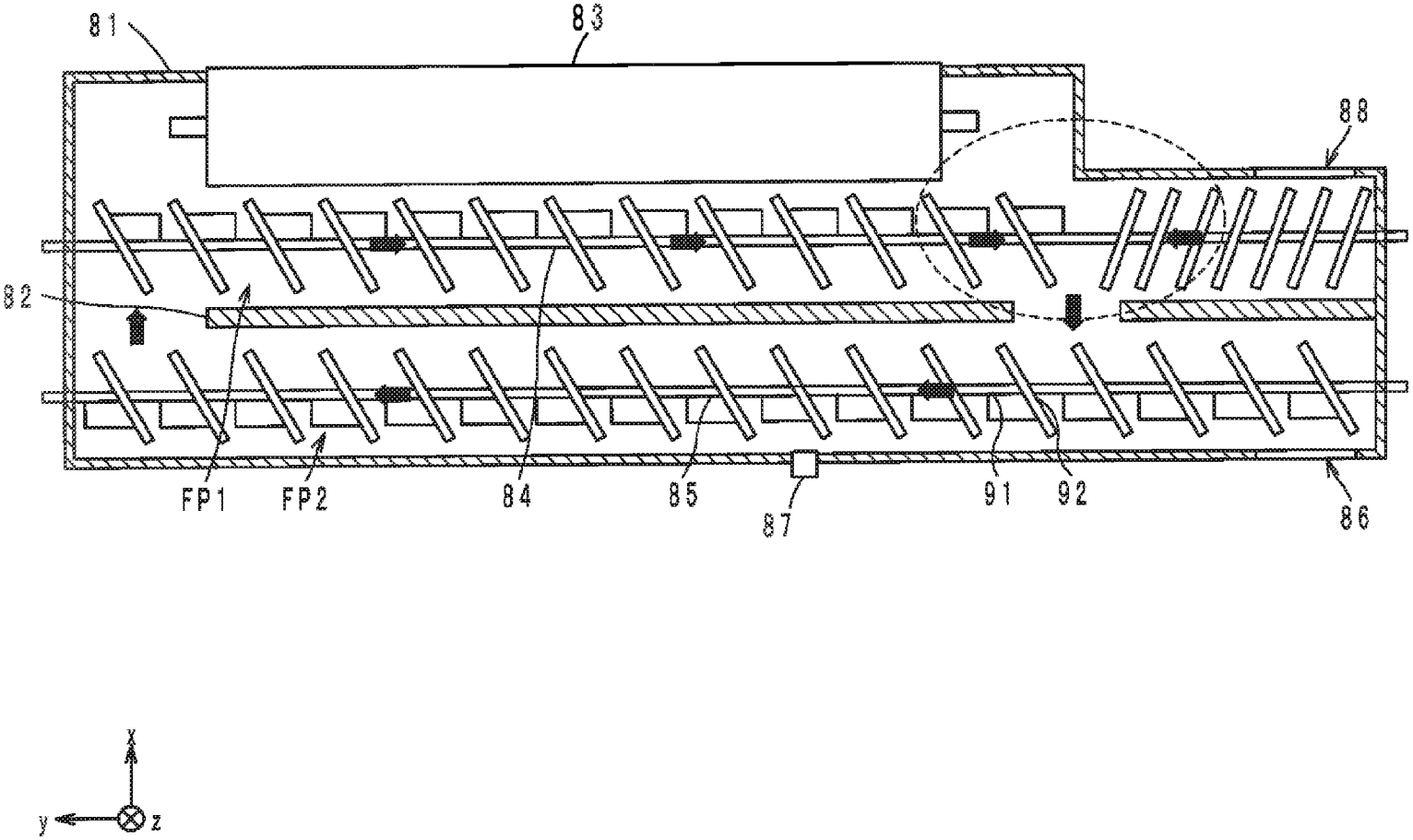
FIG. 8 is a view illustrating a trickle developing device.

Some developing devices 8 employ so-called trickle development technology, as shown in FIG. 8. In such a trickle developing device 8, through rotation of the supply screw 84, a deteriorated developer continues to be discharged in small amounts to the outside of the developer container 81 from a developer outlet 88, which is provided at the end of the first conveyance path FP1 on the negative side in the y-axis direction (i.e., the front end of the developing device 8). Correspondingly, a new developer is supplied from the replenishment port 86, which is provided at the end of the second conveyance path FP2 on the negative side in the y-axis direction (i.e., the front end of the developing device 8), in accordance with detection results from the density sensor 87.

Figure 9:
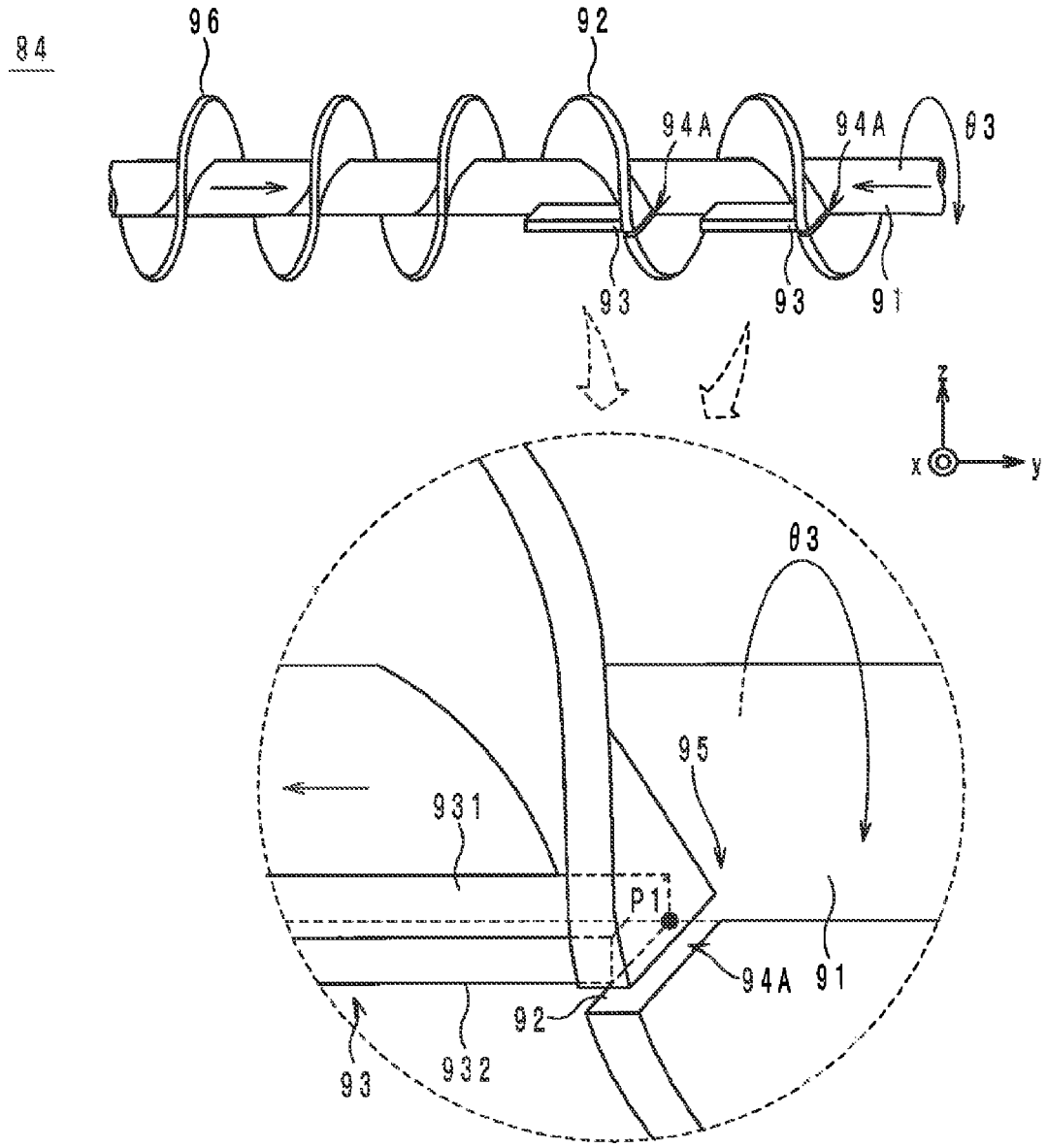
FIG. 9 is a view illustrating a stirring screw in a third modification of the first embodiment.

FIG. 9 shows a supply screw 84 used in the trickle developing device 8, along with an enlarged view of the portion enclosed within a dotted oval in FIG. 8. In FIG. 9, the supply screw 84 further includes a second blade member 96, in addition to the shaft 91, the first blade member 92, the paddle members 93, and at least one pressure relief path 94A.

In the configuration described in the present section, the shaft 91 is a columnar, rotary shaft extending in the y-axis direction, which is another example of the first direction. The shaft 91 rotates clockwise about its central axis, as indicated by arrow θ3, when viewed from negative to positive side in the y-axis direction, the clockwise direction θ3 (also referred to as the "rotational direction θ3" or simply as the "direction θ3") being another example of the second direction.

The first blade member 92 is a helical fin winding around the outer circumferential surface of the shaft 91 in the direction θ3, and the fin continues to extend helically in the first direction (i.e., the y-axis direction). Note that in the descriptions in this section, the first blade member 92 is not provided across the shaft 91 from one end to the other, but the first blade member 92 is provided so as to extend from the end of the shaft 91 on the positive side in the y-axis direction to a position toward the other end on the negative side.

The second blade member 96 is a helical fin winding around the outer circumferential surface of the shaft 91 in the direction θ3, and the fin continues to extend helically in the opposite direction to the first direction (i.e., the opposite direction to the y-axis direction). The second blade member 96 has a smaller pitch than that of the first blade member 92. Moreover, the second blade member 96 is provided so as to extend between the first blade member 92 and the end of the shaft 91 on the negative side in the y-axis direction.

The paddle members 93 protrude from different y-axis positions on the outer circumferential surface of the shaft 91 so as to be approximately perpendicular to the outer circumferential surface of the shaft 91. Moreover, the paddle members 93 are in the form of plates extending in the opposite direction to the y-axis direction. The paddle members 93 are basically provided in a straight line, one for each pitch of the first blade member 92. Furthermore, the entire end of each paddle member 93 on the negative side in the y-axis direction is not connected to the first blade member 92. In other words, no paddle member 93 exists on the upstream side in the toner conveyance direction with respect to the first blade member 92.

Furthermore, the paddle member 93 has the first principal face 931 and the second principal face 932, both of which are rectangular, and the second principal face 932 is positioned opposite to and forward from the first principal face 931 in the rotational direction θ3.

Here, at least one of the paddle members 93 that is provided on the outer circumferential surface of the shaft 91 near the end of the first blade member 92 on the negative side in the y-axis direction is referred to as a predetermined paddle member 93. In the present modification, the pressure relief path 94A is a slit provided in the first blade member 92 near the predetermined paddle member 93. The slit is provided completely through the first blade member 92 in the y-axis direction. More specifically, the intersection of the shaft 91, the first blade member 92, and the predetermined paddle member 93 includes intersection point P1, which is the foremost point of intersection in the rotational direction θ3 of the shaft 91, as shown in the dotted circle in FIG. 9. The pressure relief path 94A is a slit that is open within a predetermined distance range (about 3 mm or less) from intersection point P1.

The pressure relief path 94A may be open in the recess 95 defined by the shaft 91, the first blade member 92, and the second principal face 932 of the predetermined paddle member 93. Moreover, the pressure relief path 94A, when viewed in a plan view in the y-axis direction, may be open within an angular range of from 0° to 90° with respect to the second principal face 932 in the direction θ3.

Section 10

Actions and Effects of Third Modification of Toner Conveyance Member

Primarily, the supply screw 84 as above is disposed horizontally in the first conveyance path FP1 such that the helical progression of the first blade member 92 is in the opposite direction to the toner conveyance direction in the first conveyance path FP1. Secondarily, the supply screw 84 is disposed horizontally in the first conveyance path FP1 such that the predetermined paddle member 93 faces the communicating portion of the conveyance paths FP1 and FP2 on the negative side in the y-axis direction. At the communicating portion, the developer transported through the first conveyance path FP1 merges with the developer flowing back from the outlet 88 without being discharged, and therefore, the recess 95 defined by the shaft 91, the first blade member 92, the second face 932 of at least one predetermined paddle member 93 receives a relatively high pressure. However, since the pressure relief path 94A is provided as described above, it is possible to suppress toner aggregation in the recess 95.

Section 11

Second Embodiment of Toner Conveyance Member

A stirring screw 85 in a second embodiment of the toner conveyance member will be described in detail below with reference to FIG. 10.

The stirring screw 85 according to the second embodiment differs from the stirring screw according to the first embodiment in that at least one pressure relief path 94B is provided in place of at least one pressure relief path 94A.

Figure 10:
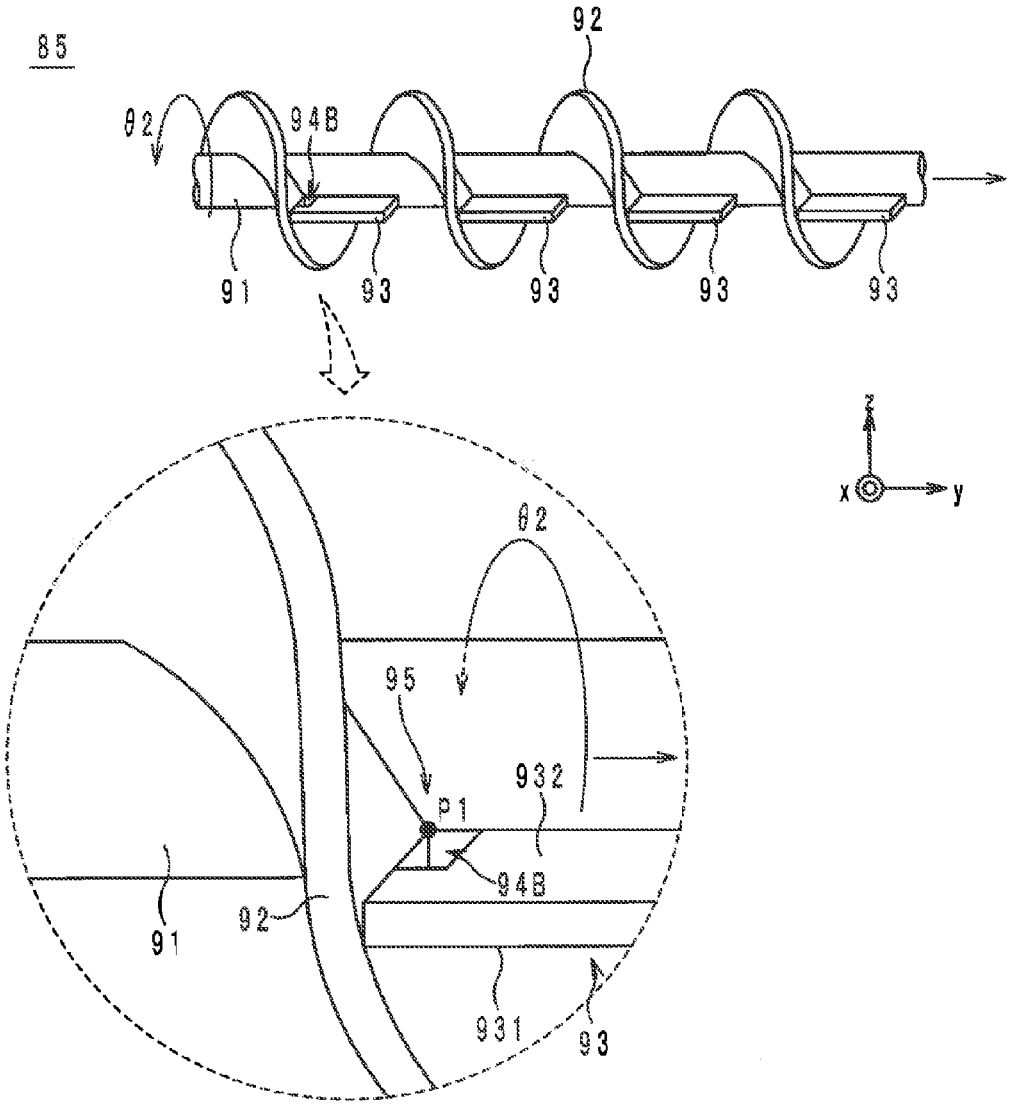
FIG. 10 is a view illustrating a stirring screw in a second embodiment of the toner conveyance member.

There are no other differences between these embodiments, therefore, in FIG. 10, the same elements as those shown in FIG. 4 are denoted by the same reference characters, and any descriptions thereof will be omitted.

The pressure relief path 94B is provided in at least one paddle member 93, and in this section, the pressure relief path 94B, when viewed in a plan view in a direction normal to the second principal face 932, is an opening provided completely through a portion of the paddle member 93, which includes intersection point P1 and its vicinity. Moreover, the pressure relief path 94B is provided in the paddle member 93 which is located at least within the detection area R4 (see FIG. 3). The pressure relief path 94B also renders it possible to achieve the actions and effects as described in Section 5.

Section 12

Pressure Relief Paths in Other Shapes

Figure 11:
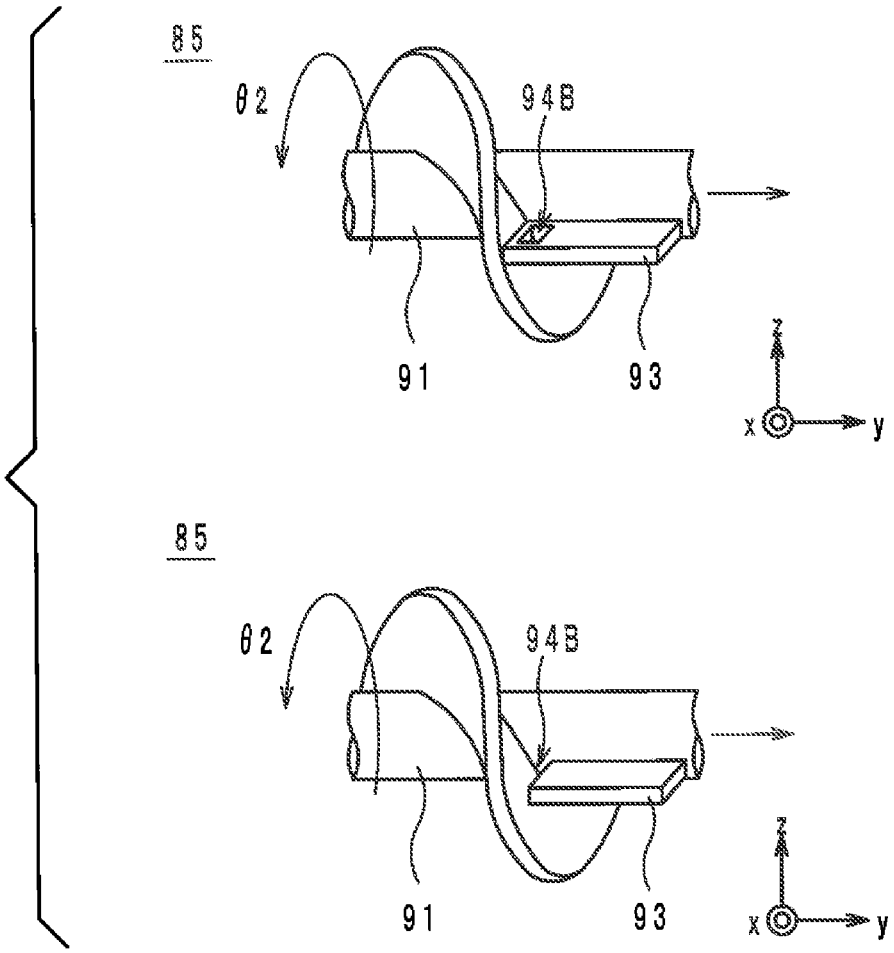
FIG. 11 is a view illustrating a pressure relief path in FIG. 10 in other shapes.

The pressure relief path 94B is not limited to the above form, and, when viewed in a plan view in a normal direction to the second principal face 932, the pressure relief path 94B may be an opening provided completely through the paddle member 93 within a predetermined distance range (up to about 3 mm) from point P1, as shown in the upper panel of FIG. 11. Alternatively, the pressure relief path 94B may be a slit provided between the first blade member 92 and the paddle member 93 within the predetermined distance range along the second face 932 of the paddle member 93, as shown in the lower panel of FIG. 11. These pressure relief paths 94B also render it possible to achieve the actions and effects as described in Section 5.

Section 13

Supplementary 1

The pressure relief paths 94B described in Sections 11 and 12 may be provided in the paddle members 93 situated in the positions described in Sections 7 through 9 or may be provided in the supply screws 84.

Section 14

Supplementary 2

In Section 4 onward, the toner conveyance member has been described as being used in the developing device 8. However, this is not limiting, and the toner conveyance member may be used in the toner conveyance path extending from the cartridge 10 to the developing device 8. Alternatively, the toner conveyance member may be used in a waste-toner conveyance path for toner discharged from the developing device 8.

Although the present invention has been described in connection with the preferred embodiment above, it is to be noted that various changes and modifications are possible to those who are skilled in the art. Such changes and modifications are to be understood as being within the scope of the invention.

What is claimed is:

1. A toner conveyance member comprising:

a shaft extending in a first direction and rotating in a second direction;

a first blade member winding around the shaft and continuing to extend helically in the first direction;

at least one paddle member being in the form of a plate protruding from a surface of the shaft and having a first principal face and a second principal face positioned opposite to and forward from the first principal face in the second direction; and a pressure relief path having an opening extending through the first blade member, wherein, the opening is provided within a predetermined distance range from an intersection point of the shaft, the first blade member, and the second principal face of the paddle member.

2. The toner conveyance member according to claim 1, wherein the opening is provided near the intersection point.

3. The toner conveyance member according to claim 1, wherein the opening is provided in a recess defined by the shaft, the first blade member, and the second principal face of the paddle member.

4. The toner conveyance member according to claim 1, wherein, the shaft varies in diameter between positions in the first direction, the paddle member protrudes from a large-diameter portion of the surface of the shaft, and the opening is provided within a predetermined distance range from an intersection point of the large-diameter portion of the shaft, the first blade member, and the second principal face of the paddle member.

5. The toner conveyance member according to claim 1, wherein, the at least one paddle member includes a plurality of paddle members protruding from different positions on the surface of the shaft in the first direction, each paddle member having a first principal face and a second principal face positioned opposite to and forward from the first principal face in the second direction, the plurality of paddle members include first and second paddle members, the first paddle member having the second principal face relatively larger than the second principal face of the second paddle member, and the opening is provided within a predetermined distance range from an intersection point of the shaft, the first blade member, and the second principal face of the first paddle member.

6. The toner conveyance member according to claim 1, further comprising a second blade member winding around the shaft and continuing to extend helically in an opposite direction to the first direction, the second blade member facing a starting end of the first blade member in the first direction, wherein, the paddle member protrudes from the surface of the shaft near the starting end of the first blade member, and the opening is provided within a predetermined distance range from an intersection point of the shaft, the first blade member, and the second principal face of the paddle member provided near the starting end of the first blade member.

7. The toner conveyance member according to claim 1, wherein the opening is provided in the first blade member so as to be positioned forward in the second direction with respect to the paddle member when viewed in a plan view in the first direction.

8. The toner conveyance member according to claim 1, wherein the opening is provided in the paddle member within a predetermined distance range from an intersection point of the shaft, the first blade member, and the second principal face of the paddle member.

9. A developing device comprising:

a container capable of storing toner;

a rotating member rotatable about an axis and disposed horizontally within the container to carry and transport the toner from the container; and the toner conveyance member of claim 1 disposed rotatably and horizontally in the container and being approximately parallel to the rotating member.

10. The developing device according to claim 9, further comprising a sensor capable of detecting a toner density in a predetermined detection area within the container, wherein, the paddle member protrudes from a portion of the shaft that crosses the predetermined area, and the opening is provided within a predetermined distance range from an intersection point of the shaft, the first blade member, and the second principal face of the paddle member provided on the portion of the shaft that crosses the predetermined area.

11. The developing device according to claim 9, further comprising a partition provided in the container and extending in an axial direction of the rotating member, thereby defining a first conveyance path and a second conveyance path communicating with each other at least in two different places, wherein, the toner conveyance member spans from one side to the other in at least one of the first conveyance path and the second conveyance path, and is approximately parallel to the rotating member, the paddle member protrudes from a surface of the shaft where the shaft faces the communicating portion of the first conveyance path and the second conveyance path, and the opening is provided within a predetermined distance range from an intersection point of the shaft, the first blade member, and the second principal face of the paddle member provided on the portion of the shaft that faces the communicating portion.

12. An image forming apparatus comprising:

the toner conveyance member of claim 1, or a developing device comprising:

a container capable of storing toner;

a rotating member rotatable about an axis and disposed horizontally within the container to carry and transport the toner from the container; and the toner conveyance member of claim 1 disposed rotatably and horizontally in the container and being approximately parallel to the rotating member.

13. A toner conveyance member comprising:

a shaft extending in a first direction and rotating in a second direction;

a first blade member winding around the shaft and continuing to extend helically in the first direction;

at least one paddle member being in the form of a plate protruding from a surface of the shaft and having a first principal face and a second principal face positioned opposite to and forward from the first principal face in the second direction; and a pressure relief path having an opening extending through the first blade member, wherein, the opening is provided in a recess defined by the shaft, the first blade member, and the second principal face of the paddle member.

14. A toner conveyance member comprising:

a shaft extending in a first direction and rotating in a second direction;

a first blade member winding around the shaft and continuing to extend helically in the first direction;

at least one paddle member being in the form of a plate protruding from a surface of the shaft and having a first principal face and a second principal face positioned opposite to and forward from the first principal face in the second direction; and a pressure relief path having an opening, wherein, the opening is provided within a predetermined distance range from an intersection point of the shaft, the first blade member, and the second principal face of the paddle member, and the opening is provided in the first blade member so as to be positioned forward in the second direction with respect to the paddle member when viewed in a plan view in the first direction.

* * * * *